US010330105B2

(12) United States Patent
Gonzalez

(10) Patent No.: US 10,330,105 B2
(45) Date of Patent: Jun. 25, 2019

(54) COMPRESSOR INCLUDING FLOW CONTROL INSERT AND ELECTROMAGNETIC ACTUATOR

(71) Applicant: DANFOSS A/S, Nordborg (DK)

(72) Inventor: Delvis Anibal Gonzalez, Tallahassee, FL (US)

(73) Assignee: DANFOSS A/S (DK)

( * ) Notice: Subject to any disclaimer, the term of this patent is extended or adjusted under 35 U.S.C. 154(b) by 571 days.

(21) Appl. No.: 14/915,382

(22) PCT Filed: Aug. 27, 2013

(86) PCT No.: PCT/US2013/056757

§ 371 (c)(1),
(2) Date: Feb. 29, 2016

(87) PCT Pub. No.: WO2015/030723

PCT Pub. Date: Mar. 5, 2015

(65) Prior Publication Data

US 2016/0208809 A1 Jul. 21, 2016

(51) Int. Cl.

| | |
|---|---|
| ***H01F 7/06*** | (2006.01) |
| ***F04D 17/10*** | (2006.01) |
| ***F04D 27/00*** | (2006.01) |
| ***F04D 27/02*** | (2006.01) |
| ***F04D 29/28*** | (2006.01) |
| ***F04D 29/44*** | (2006.01) |

(Continued)

(52) U.S. Cl.

CPC ..... *F04D 27/002* (2013.01); *F04D 17/10* (2013.01); *F04D 27/0246* (2013.01); *F04D 29/284* (2013.01); *F04D 29/444* (2013.01); *F04D 29/462* (2013.01); *F04D 29/464* (2013.01); *H01F 7/064* (2013.01); *F05D 2250/52* (2013.01); *F05D 2270/62* (2013.01); *F25B 1/053* (2013.01)

(58) Field of Classification Search

CPC .... F04D 27/02; F04D 27/0246; F04D 29/462; F04D 29/464; F04D 29/444; F04D 29/284; F04D 17/10; H01F 7/064

See application file for complete search history.

(56) References Cited

U.S. PATENT DOCUMENTS

| | | | |
|---|---|---|---|
| 3,362,624 | A | 1/1968 | Endress |
| 3,362,625 | A | 1/1968 | Endress |
| 4,219,305 | A | 8/1980 | Mount et al. |

(Continued)

FOREIGN PATENT DOCUMENTS

| | | | | |
|---|---|---|---|---|
| CH | 407401 | A | 2/1966 | |
| DE | 1913048 | A1 | 2/1970 | |
| WO | WO 2012087306 | A1 * | 6/2012 | ..... F04D 29/444 |

OTHER PUBLICATIONS

The International Preliminary Report on Patentability for PCT Application No. PCT/US2013/056757, dated Mar. 10, 2016.

*Primary Examiner* — Ninh H. Nguyen
*Assistant Examiner* — Brian P Wolcott
(74) *Attorney, Agent, or Firm* — Carlson, Gaskey & Olds, P.C.

(57) ABSTRACT

A centrifugal compressor is disclosed. The compressor includes an impeller, an electromagnetic actuator, and a flow control insert. The flow control insert is selectively moveable in response to the electromagnetic actuator to regulate a flow of fluid expelled by the impeller.

12 Claims, 6 Drawing Sheets

(51) Int. Cl.
*F04D 29/46* (2006.01)
*F25B 1/053* (2006.01)

(56) References Cited

U.S. PATENT DOCUMENTS

| | | | | |
|---|---|---|---|---|
| 4,378,194 | A | 3/1983 | Bandukwalla | |
| 4,616,483 | A * | 10/1986 | Leonard | F01D 17/143 415/47 |
| 4,802,817 | A | 2/1989 | Tyler | |
| 4,844,690 | A | 7/1989 | Delaurier et al. | |
| 4,969,798 | A | 11/1990 | Sakai et al. | |
| 5,350,039 | A | 9/1994 | Voss et al. | |
| 5,669,756 | A | 9/1997 | Brasz et al. | |
| 5,683,223 | A | 11/1997 | Harada et al. | |
| 5,807,071 | A | 9/1998 | Brasz et al. | |
| 6,814,540 | B2 | 11/2004 | Sishtla et al. | |
| 6,997,686 | B2 | 2/2006 | Agrawal et al. | |
| 7,856,834 | B2 | 12/2010 | Haley | |
| 7,905,102 | B2 | 3/2011 | Bodell, II et al. | |
| 8,287,232 | B2 | 10/2012 | Gu et al. | |
| 8,434,734 | B2 * | 5/2013 | Birkelund | F16K 31/06 251/122 |
| 9,121,408 | B2 * | 9/2015 | Shioda | F04D 27/0246 |
| 9,212,667 | B2 * | 12/2015 | Sun | F04D 29/444 |
| 9,874,266 | B2 * | 1/2018 | Yang | F16H 3/006 |
| 10,006,356 | B2 * | 6/2018 | Kemmerling | F02B 37/24 |
| 2005/0066674 | A1 | 3/2005 | Hirota et al. | |
| 2011/0048046 | A1 | 3/2011 | Sommer et al. | |
| 2013/0036760 | A1 | 2/2013 | Sun et al. | |
| 2013/0064682 | A1 | 3/2013 | Sun et al. | |

* cited by examiner

COMPRESSOR INCLUDING FLOW CONTROL INSERT AND ELECTROMAGNETIC ACTUATOR

BACKGROUND

Centrifugal refrigerant compressors are known, and include one or more impellers driven by a motor. During operation of a centrifugal compressor, refrigerant is expelled outward from the impeller. One known compressor type includes a vaneless diffuser configured to regulate the flow of fluid expelled by the impeller. Another known compressor type includes a vaned diffuser. Vaned diffusers are known to include mechanical and/or hydraulic actuators capable of either turning the diffuser vanes or moving a sidewall relative to the diffuser.

SUMMARY

One exemplary embodiment of this disclosure relates to a centrifugal compressor. The compressor includes an impeller, an electromagnetic actuator, and a flow control insert. The flow control insert is selectively moveable in response to the electromagnetic actuator to regulate a flow of fluid expelled by the impeller.

Another exemplary embodiment of this disclosure relates to a method for regulating a flow of fluid. The method includes expelling a flow of fluid from an impeller, and positioning a flow control insert in response to an electromagnetic actuator to regulate the flow of fluid expelled by the impeller.

These and other features of the present disclosure can be best understood from the following drawings and detailed description.

BRIEF DESCRIPTION OF THE DRAWINGS

The drawings can be briefly described as follows.

DETAILED DESCRIPTION

Figure 1:
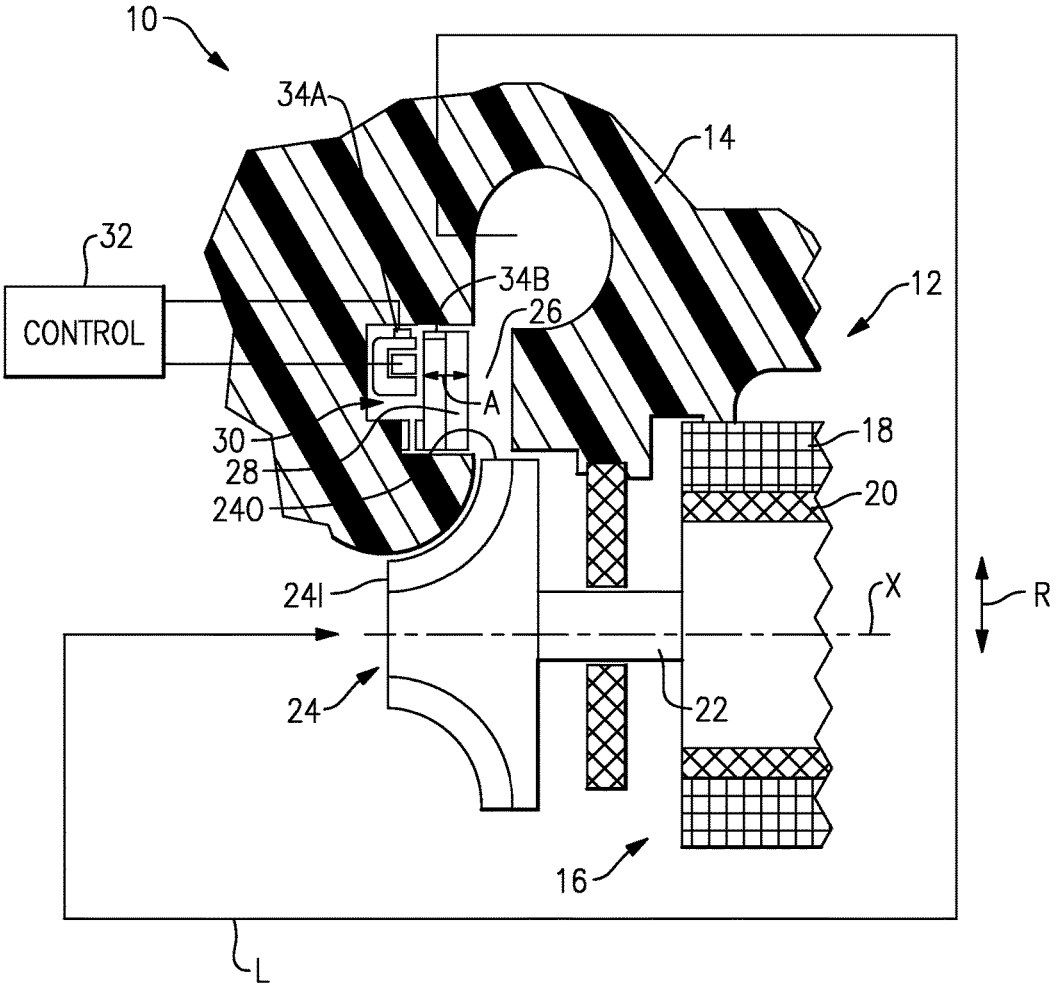
FIG. 1 is a highly schematic view of a refrigeration system.

FIG. 1 schematically illustrates an example refrigeration system 10. In the example, the refrigeration system 10 includes a centrifugal refrigerant compressor 12 for circulating a refrigerant. The compressor 12 includes a housing 14 within which an electric motor 16 is arranged. In one example, the electric motor 16 includes a stator 18 arranged radially outside of a rotor 20. The rotor 20 is mechanically coupled to a rotor shaft 22, which rotates about an axis X to drive an impeller 24 to compress refrigerant. Although only one impeller 24 is shown, this disclosure may be used in connection with compressors having more than one impeller. Further, while a refrigeration system 10 is illustrated, it should be understood that this disclosure applies to other systems.

The compressor 12 is in fluid communication with a refrigeration loop L. While not illustrated, refrigeration loops, such as the refrigeration loop L, are known to include a condenser, an evaporator, and an expansion device.

Figure 3A:
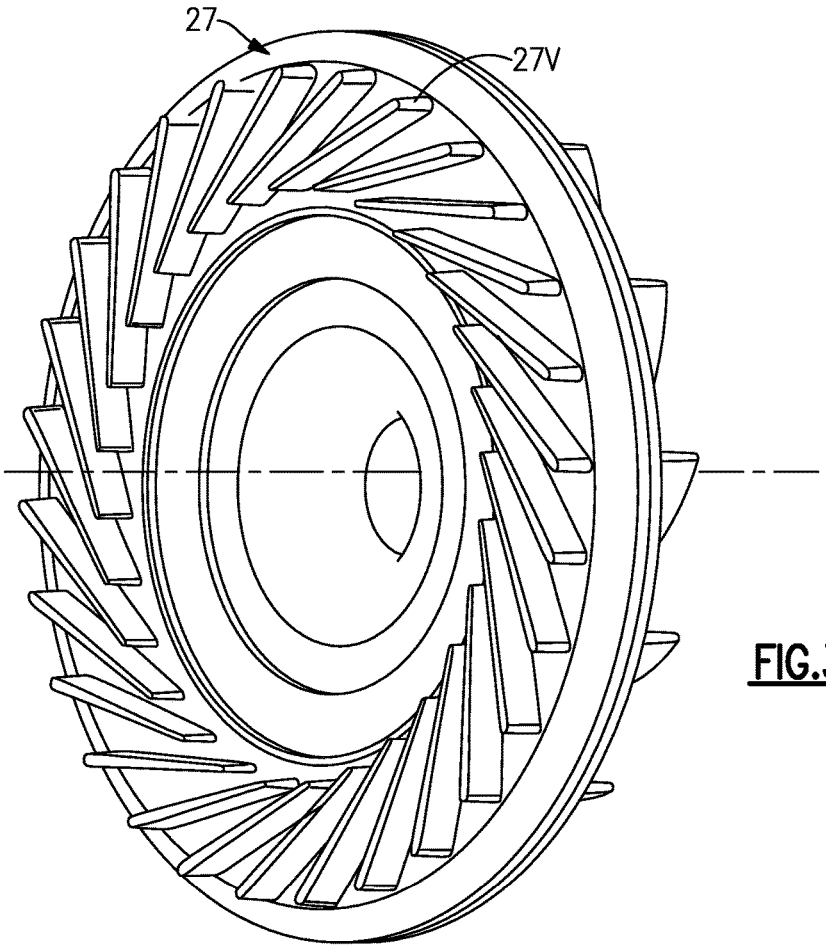
FIG. 3A illustrates an example vaned diffuser.

During operation of the compressor 12, refrigerant enters the impeller 24 through an inlet end 24I, and is expelled radially outward from an outlet end 24O thereof. Downstream of the outlet end 24O, the refrigerant passes through a throat 26, and ultimately back to the refrigerant loop L. It should be understood that the throat 26 may include a diffuser 27 (FIG. 3A) in at least one example. In this example, the diffuser 27 includes a plurality diffuser vanes 27V.

Figure 3B:
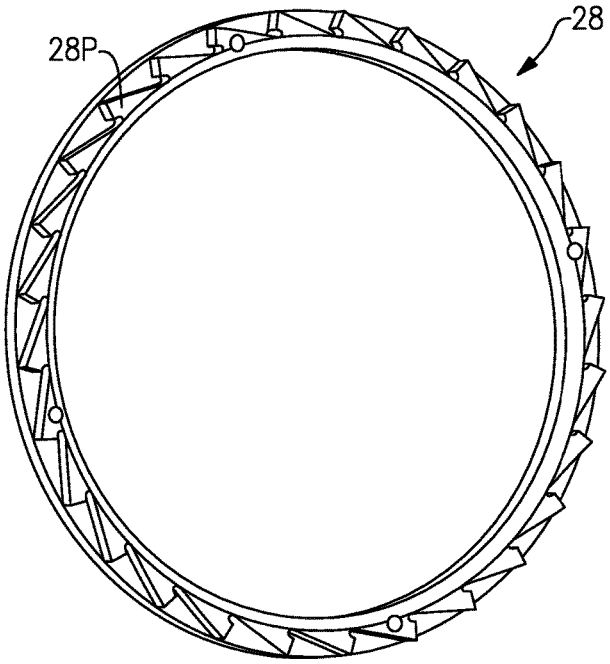
FIG. 3B illustrates an example flow control insert.
Figure 3C:
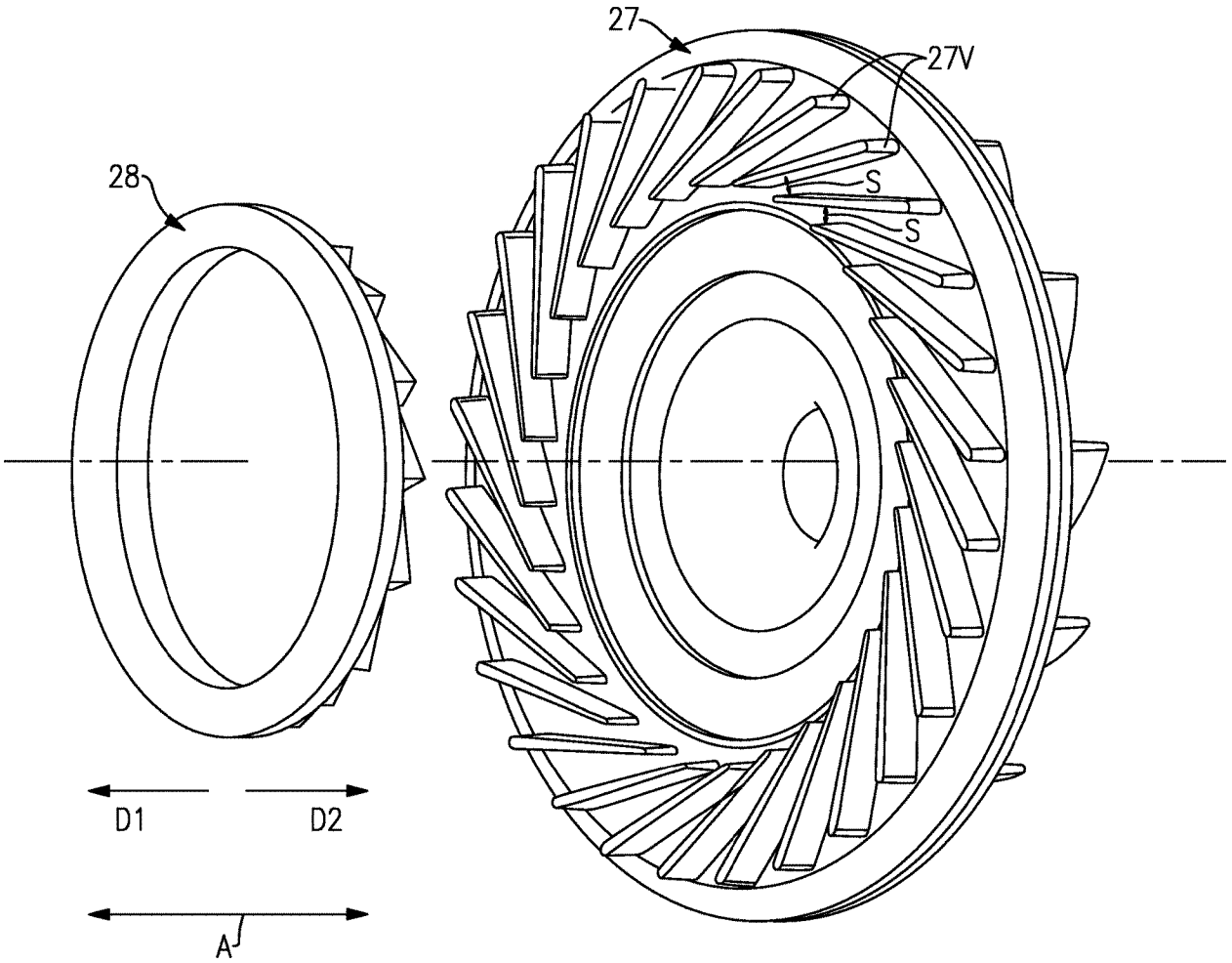
FIG. 3C illustrates the vaned diffuser of FIG. 3A and the flow control insert of FIG. 3B.

A moveable flow control insert 28 is positioned radially downstream of the outlet end 24O of the impeller 24, and is moveable to selectively regulate a flow of fluid expelled from the impeller 24. In this example, the flow control insert 28 is moveable by way of an electromagnetic actuator 30 in a generally axial direction A, which is substantially parallel to the axis of rotation X of the impeller 24. In the example where a vaned diffuser 27 is included in the throat 26, the flow control insert 28 would include projections 28P (FIG. 3B) corresponding to spaces S (FIG. 3C) between adjacent diffuser vanes 27V. The projections 28P in this example axially move in-and-out of spaces S between adjacent diffuser vanes 27V (e.g., as illustrated in FIG. 3C).

The electromagnetic actuator 30 is controlled by a control 32. The control 32 is an electronic control, and, as is known in the art, is capable of being programmed to perform numerous functions, including sending instructions to control various components of a system. In one example, the control 32 is in communication with two separate circuits. One circuit is a control circuit, which is very low voltage (signal). Another circuit is a power circuit which carries current and higher voltage (e.g., 250 VDC).

In the illustrated example, the control 32 is in communication with position sensor 34A (e.g., via the control circuit) configured to detect the relative position of the flow control insert 28 relative to the throat 26, by sensing a distance between the position sensor 34A and a sensor target 34B mounted to the flow control insert. In this example, the control 32 uses information from the position sensor 34A to control the force generated by the electromagnetic actuator 30 by controlling the electric current flowing to the coil 44. The position sensor 34A and sensor target 34B are optional, however, and the control 32 can use other information (such as a pressure differential) indicative of the position of the flow control insert 28 when instructing the electromagnetic actuator 30. The position sensor components 34A can be any known component configured to generate a signal (capable of being interpreted by the control 32) corresponding to a distance between the position sensor 34A and sensor target 34B. The control 32 is further in communication with a variable voltage or current source (not shown), in order to provide a desired level of electric current to the electromagnetic actuator 30, as will be discussed below.

Figure 2:
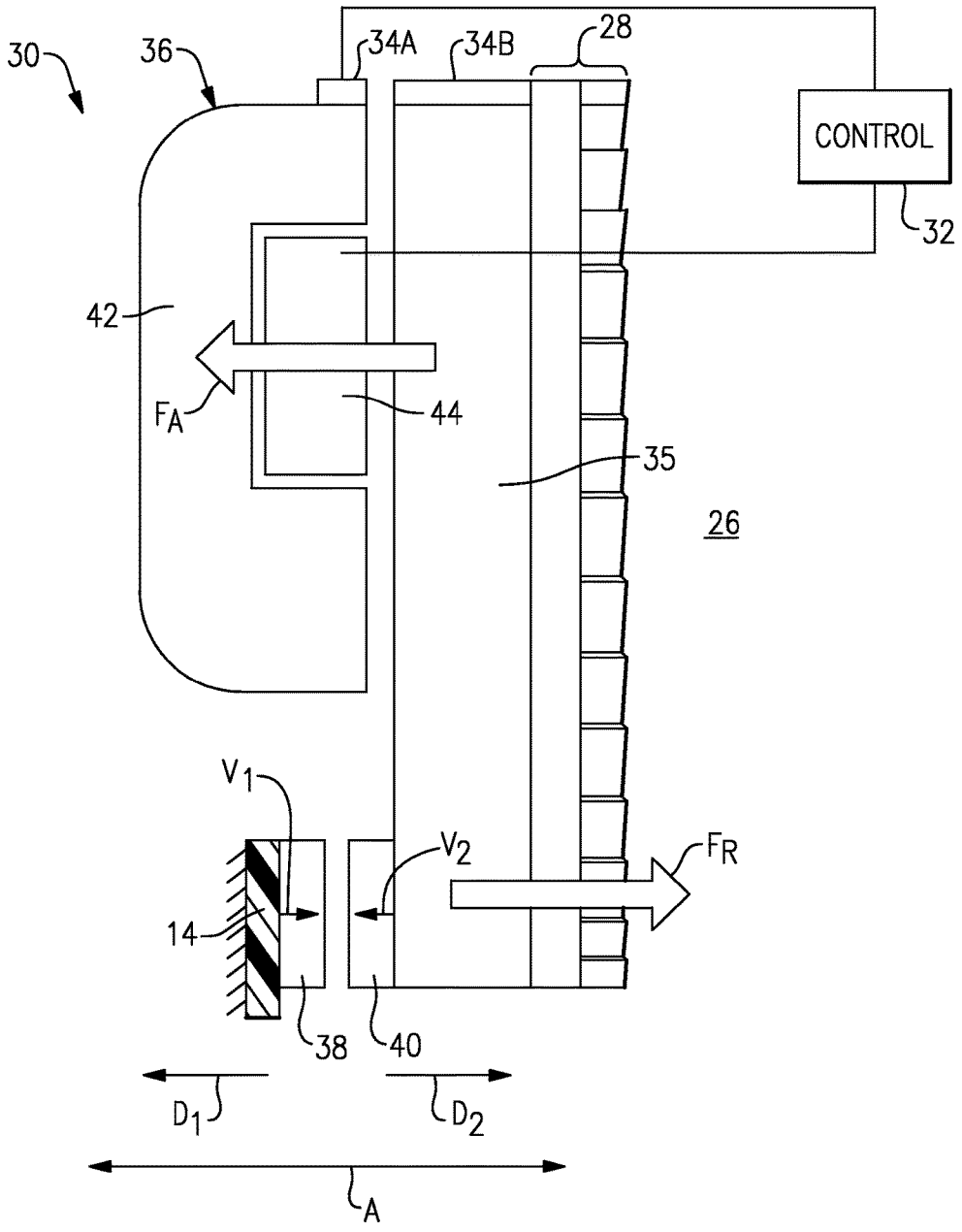
FIG. 2 schematically illustrates the electromagnetic actuator of FIG. 1.

FIG. 2 illustrates the detail of the electromagnetic actuator 30. In this example, the electromagnetic actuator 30 includes an electromagnet 36 and first and second permanent magnets 38, 40. The electromagnet 36 includes a core 42 and a coil 44 arranged within the core 42. The control 32 is configured to provide a variable level of electric current to the coil 44 (e.g., via the power circuit). Depending on the level of electric current flowing through the coil 44, the magnetic field generated by the electromagnet 36 varies. The permanent magnets 38, 40, on the other hand, generate a substantially constant magnetic field.

It should be understood that while FIGS. 1 and 2 only illustrate a partial sectional view of this disclosure, the electromagnet 36 can be configured to continuously extend circumferentially around the axis of rotation X. Sets of the first and second permanent magnets 38, 40 in one example are circumferentially spaced 90° apart relative to the axis of rotation X. In another example, sets of the permanent magnets 38, 40 are circumferentially spaced 120° apart. The sets of permanent magnets 38, 40 may be spaced at any angle, however in some examples it is important to equally space the permanent magnets about the axis of rotation X.

In this example, the first permanent magnet 38 is mounted to the housing and is stationary relative to the flow control insert 28. The second permanent magnet 40 is moveable with the flow control insert 28. The first permanent magnet 38 is arranged to generate a first magnetic field vector $V_1$ which is generally opposite to the magnetic field vector $V_2$ generated by the second permanent magnet 40. This results in a repulsion force $F_R$ between the first and second permanent magnets 38, 40, which biases the flow control insert in a direction $D_2$ toward the throat area 26, and away from the electromagnetic actuator 30.

The control 32 is configured to provide a flow of electric current to the coil 44 to generate an attraction force $F_A$ which attracts the flow control insert 28 in a direction $D_1$, against the repulsion force $F_R$ of the first and second permanent magnets 38, 40. The control 32 can thus vary the level of electric current flowing through the coil 44 to selectively adjust the position of the flow control insert 28.

In an open position, the control 32 provides a flow of electric current through the coil 44 that results in an attraction force $F_A$ that substantially overcomes the repulsion force $F_R$ to move the flow control insert 28 to a position where flow in the throat area 26 is substantially uninhibited by the flow control insert 28. In a closed position on the other hand, the control 32 essentially provides no current to the coil 44, and thus the flow control insert 28 will be under the influence of repulsion force $F_R$ and will move to substantially block the throat area 26. The control 32 can further provide a level of electric current to the coil 44 to position the flow control insert 28 at any number of intermediate positions axially between the open and closed positions, wherein flow in the throat area 26 is partially blocked.

In the closed position, in one example, the flow control insert 28 essentially reduces the throat area 26 by 80% relative to the open position. In another example, the flow control insert 28 reduces the throat area 26 by 50% relative to the open position. This number may vary as needed, and depending on the selected contour of the flow control insert 28.

In the example of FIGS. 1 and 2, the flow control insert 28 is attached to a moving target structure, which in this example is a disk, 35, which is used to support the second permanent magnet 40 and the flow control insert 28. While not illustrated, the moving target structure 35 may move along axial guides arranged relative to the housing 14. In one example, the sensor target 34B attached to this moving target structure 35, as is the second permanent magnet 40. However, in other examples, there is no moving target structure 35, and the sensor target 34B and second permanent magnet 40 can be directly attached to the flow control insert 28. In this example, the moving target 35 is a magnetic structure that is responsive to the magnetic field created by the electromagnet 36. In the example without a moving target structure 35, the flow control insert 28 would be at least partially magnetic and thus be configured to respond to the magnetic field created by the electromagnet 36.

This disclosure may be particularly beneficial when used in refrigerant compressors, and other types hermetically sealed working environments. In part, this is because there are no mechanical components required to adjust the position of the flow control insert 28. Thus, the flow of fluid expelled by the impeller 24 can be regulated without the need to monitor and maintain mechanical components, which in turn increases the efficiency and reliability of the system. This disclosure further simplifies the prior systems (which include various mechanical and/or hydraulic components) by reducing the number of moving components. Further still, this disclosure increases the stable operating range of the compressor (relative to compressors including vaneless diffusers) while preserving the increased pressure recovery and resulting overall efficiency attributed to vaned diffusers.

Figure 4:
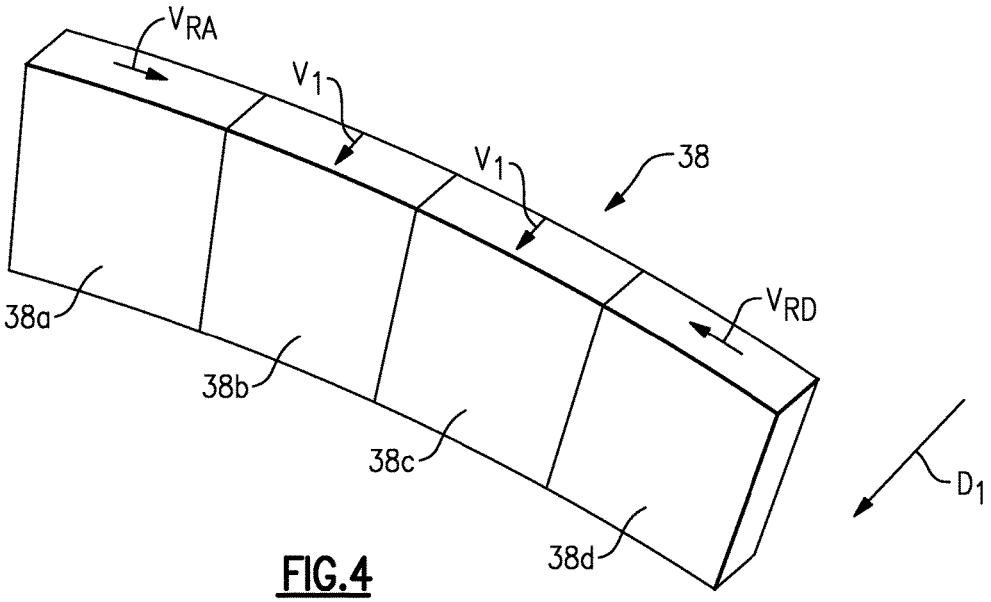
FIG. 4 illustrates an example permanent magnet array.

FIG. 4 schematically illustrates an example wherein the first permanent magnet 38 includes a semi-Halbach array (or, partial Halbach array) of permanent magnets 38*a*-38*d*. It should be understood that the second permanent magnet 40 includes a similar arrangement in one example, in such a way that the resulting magnetic flux is in an opposite direction than the magnetic flux of the first permanent magnet 38. As is known in the art, Halbach arrays are arrangements of permanent magnets that augments the magnetic field on one side of the array while cancelling the field to near zero on the other side. In this example, the outer permanent magnets 38*a* and 38*d* generate a magnetic flux along circumferential vectors VRA, VRD, toward the inner permanent magnets 38*b* and 38*c*. This concentrates the magnetic flux between the magnets 38*a*-38*d*, and increases (e.g., augments) the magnetic flux created by the middle magnets 38*b* and 38*c* along the vector V1. This in turn maximizes the repulsion force FR.

Figure 5A:
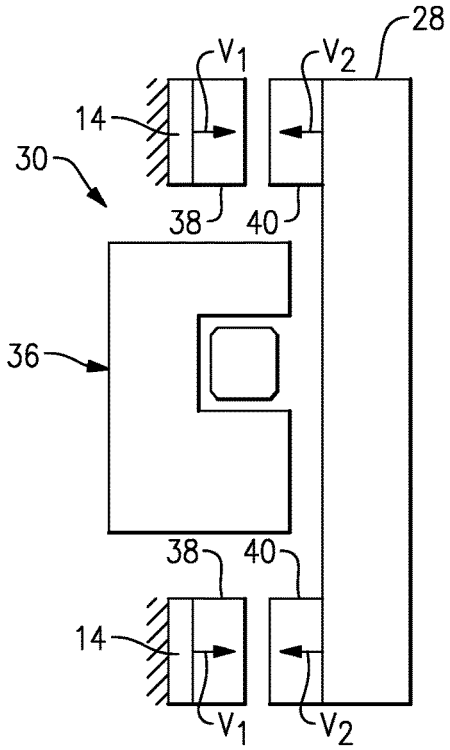
FIGS. 5A-5C schematically illustrate alternative electromagnetic actuator arrangements.
Figure 5B:
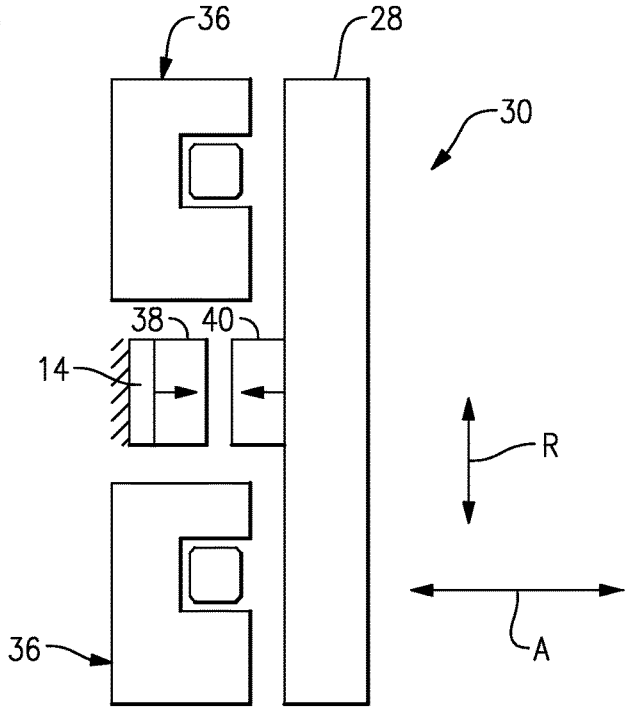
Figure 5C:
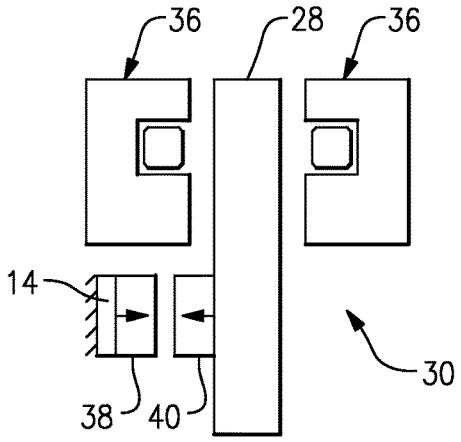

FIGS. 5A-5C illustrate three alternate electromagnetic actuator arrangements. In a first example, in FIG. 5A, two sets of permanent magnets 38, 40 are included on radially opposite sides of the electromagnet 36. In the example of FIG. 5B, two electromagnets 36 are provided, and are positioned on radially opposite sides of the first and second permanent magnets 38, 40. The example of FIG. 5C also includes two electromagnets 36, however these electromagnets 36 are provided on opposite axial sides of the moving target structure 35. One skilled in this art can select an appropriate actuator arrangement.

Although the different examples have the specific components shown in the illustrations, embodiments of this disclosure are not limited to those particular combinations. It is possible to use some of the components or features from one of the examples in combination with features or components from another one of the examples.

One of ordinary skill in this art would understand that the above-described embodiments are exemplary and non-limiting. That is, modifications of this disclosure would come within the scope of the claims. Accordingly, the following claims should be studied to determine their true scope and content.

What is claimed is:

1. A centrifugal compressor, comprising:

an impeller;

an electromagnetic actuator; and a flow control insert selectively moveable in response to the electromagnetic actuator to regulate a flow of fluid expelled by the impeller;

a control in communication with the electromagnetic actuator to selectively move the flow control insert;

wherein the electromagnetic actuator includes at least one electromagnet having a coil;

wherein a level of current flowing through the coil determines a magnetic field generated by the electromagnet;

wherein the control is configured to control a level of electric current flowing through the coil;

wherein the electromagnetic actuator includes a first permanent magnet and a second permanent magnet;

wherein the first permanent magnet is stationary relative to the flow control insert, and the second permanent magnet is moveable with the flow control insert; and wherein the first permanent magnet and the second permanent magnet provide a first force that urges the flow control insert in a first direction.

2. The centrifugal compressor as recited in claim 1, wherein the centrifugal compressor is included in a refrigeration system.

3. The centrifugal compressor as recited in claim 1, wherein the control is configured to control a level of electric current flowing through the coil to provide a second force that urges the flow control insert in a second direction opposite the first direction.

4. The centrifugal compressor as recited in claim 3, wherein the flow control insert is moveable between an open position, a closed position, and any number of intermediate positions depending on the level of electric current flowing through the coil.

5. The centrifugal compressor as recited in claim 4, wherein, when the flow control insert is in the open position, a flow of fluid expelled by the impeller is substantially uninhibited by the flow control insert.

6. The centrifugal compressor as recited in claim 5, wherein, when the flow control insert is in a closed position, a flow of fluid expelled by the impeller is substantially blocked by the flow control insert.

7. The centrifugal compressor as recited in claim 6, wherein, when the flow control insert is in an intermediate position, the flow control insert is positioned axially between the open and closed positions, and a flow of fluid expelled by the impeller is partially inhibited by the flow control insert.

8. The centrifugal compressor as recited in claim 2, including a position sensor having at least one component moveable with the flow control insert, the control in communication with the position sensor.

9. The centrifugal compressor as recited in claim 1, wherein a diffuser is included downstream of the impeller, wherein the diffuser is a vaned diffuser having a plurality of diffuser vanes, the flow control insert selectively moveable in-and-out of passageways between adjacent diffuser vanes.

10. The centrifugal compressor as recited in claim 1, including a moving target moveable with the flow control insert, the moving target being at least partially magnetic such that the moving target is responsive to the electromagnetic actuator.

11. The centrifugal compressor as recited in claim 1, wherein the flow control insert is at least partially magnetic such that the flow control insert is responsive to the electromagnetic actuator.

12. A centrifugal compressor, comprising:

an impeller;

an electromagnetic actuator;

a flow control insert selectively moveable in response to the electromagnetic actuator to regulate a flow of fluid expelled by the impeller;

a control in communication with the electromagnetic actuator to selectively move the flow control insert;

wherein the electromagnetic actuator includes at least one electromagnet having a coil;

wherein a level of current flowing through the coil determines a magnetic field generated by the electromagnet;

wherein the control is configured to control a level of electric current flowing through the coil;

wherein the electromagnetic actuator includes a first permanent magnet and a second permanent magnet;

wherein the first permanent magnet is stationary relative to the flow control insert, and the second permanent magnet is moveable with the flow control insert; and wherein each of the first and second permanent magnets are provided by respective semi-Halbach arrays, each semi-Halbach array having a plurality of permanent magnets.

* * * * *